US005172630A

United States Patent [19]

Thompson

[11] Patent Number: 5,172,630

[45] Date of Patent: Dec. 22, 1992

[54] TRASH SEPARATION AND STORAGE SYSTEM

[76] Inventor: Richard M. Thompson, Star Rte. Box 98, Meriden, N.H. 03770

[21] Appl. No.: 804,819

[22] Filed: Jan. 17, 1992

[51] Int. Cl.[5] ..... B30B 15/00; B30B 7/00

[52] U.S. Cl. ..... 100/193; 100/223; 100/225; 100/229 A; 100/237

[58] Field of Search ..... 100/193, 221, 223, 225, 100/229 A, 233, 237; 4/629; 220/909

[56] References Cited

U.S. PATENT DOCUMENTS

| | | | |
|---|---|---|---|
| 425,481 | 4/1890 | Wolfe | 100/223 |
| 2,800,159 | 7/1957 | Walsh et al. . | |
| 2,984,957 | 5/1961 | Lundgren . | |
| 3,232,220 | 2/1966 | Sileski . | |
| 3,352,233 | 11/1967 | Lalonde et al. | 100/223 X |
| 3,438,321 | 4/1969 | Gladwin . | |
| 3,531,909 | 10/1970 | Edebalk . | |
| 3,540,495 | 11/1970 | Lundgren | 100/223 X |
| 3,552,454 | 1/1971 | Deming, Sr. | 100/223 X |
| 3,782,068 | 1/1974 | Weydan et al. . | |
| 3,808,967 | 5/1974 | Fair et al. . | |
| 4,098,181 | 7/1978 | Schultz . | |
| 4,102,263 | 7/1978 | Forsberg . | |
| 4,212,241 | 7/1980 | Pinette | 100/223 X |
| 4,303,412 | 12/1981 | Baikoff | 100/223 X |
| 5,119,722 | 6/1992 | Carter et al. | 100/221 |

FOREIGN PATENT DOCUMENTS

| | | | |
|---|---|---|---|
| 2208373 | 9/1973 | Fed. Rep. of Germany | 100/221 |
| 2816049 | 10/1979 | Fed. Rep. of Germany | 100/223 |
| 386371 | 4/1965 | Switzerland | 100/223 |

*Primary Examiner*—Harvey C. Hornsby
*Assistant Examiner*—Stephen F. Gerrity
*Attorney, Agent, or Firm*—Michael J. Weins

[57] ABSTRACT

The present invention is related to a trash storage system suitable for multiple compartments for selectively compacting and storing the trash generated in a home for subsequent recycling. This trash storage system preferably has a programmable micro controller that allows the selective loading of compartments and compaction of compartments. The trash storage system of the present invention can be mounted under the counter in a kitchen and when so mounted has a front opening that allows the input and removal of trash.

10 Claims, 9 Drawing Sheets

TRASH SEPARATION AND STORAGE SYSTEM

FIELD OF THE INVENTION

The present invention is for a trash storage system providing segregated storage and selective compaction. In particular, the present invention is for a system where the trash can be sorted, stored, and compacted in accordance with local recycling requirements.

BACKGROUND ART

Recently there has been increased awareness in society that materials must be recycled, making disposal of trash an area for social concern. Furthermore, use of recycled materials helps preserve natural resources and conserves energy by eliminating the energy requirement associated with converting these natural resources to industrial materials.

The storage of trash requires space, which is a prime consideration in today's kitchens. Space limitation for the storage of trash has largely been overcome by trash compactors which substantially reduce the volume of the trash, thus providing manageable levels. However, these devices provide for neither the sorting of trash nor the separate storage of sorted trash.

Separation of trash simplifies the recycling of reclaimable materials and, in some locations, is a requirement before material will be accepted for recycling. Storage systems which separate and consolidate trash find limited teaching in patent literature. The systems described therein at best offer partial solutions to the separation and storage of trash.

The separation of trash is addressed in U.S. Pat. No. 4,102,263 and U.S. Pat. No. 4,098,181. These patents require a redundancy of compaction equipment including multiple loading openings where each opening has a separate volume reduction device. The redundancy not only increases equipment requirements but also increases the space requirements. These factors make the systems of the '263 and the '181 patents not well suited for home use. Furthermore, these devices are designed to compact all materials and thus do not provide for "as is" storage.

Another approach to a storage system is taught in U.S. Pat. No. 2,800,159 where glass and metal are crushed in the same compartment but in separate operations; the crushed materials are then diverted to separate compartments. In the system set forth in the '159 patent there is no provision for "as is" storage of trash. The ability to store glass "as is" is particularly important. In fact, in some communities glass will be accepted only "as is", ie. the uncrushed form. Furthermore, the compactor of the '159 patent is not well suited to the compaction and storage of plastic because, when the compaction pressure is removed, the plastic may elastically spring back and jam the compactor of the '159 patent.

Yet another approach to trash compaction is taken by U.S. Pat. No. 3,232,220, which is to crush a mixture of metal and glass and separate the materials after crushing The compactor of the '220 patent handles soft rubbish, such as paper, in a separate chamber. Handling soft rubbish as set forth in the '220 patent gives rise to redundant processing equipment, which again increases the space requirement. Also the '220 patent fails to make provisions for the separate storage of plastic so that it can be readily recycled. This system also suffers from the shortcoming that there is no provision for "as is" storage of glass.

Thus, while there have been multiple partial solutions to separating and compacting trash, there is a need for a space efficient trash storage and compacting system for home use where trash may be separated, stored and selectively compacted.

SUMMARY OF THE INVENTION

It is an object of the invention to provide a compact trash storage system which is small in size and provides for the separation, selective compaction, and storage of trash.

It is a another object of the invention to provide a trash storage system well suited for installation under a kitchen counter.

It is still another object of the invention to provide a trash storage system wherein storage compartments are accessed through a single input opening.

It is a further object of the invention to provide a front loading trash storage system.

It is yet another object of the invention to provide a trash storage system wherein the trash is unloaded through the front of the unit.

It is another object of the invention to provide a trash storage system employing a single compacting platen and drive mechanism for compaction.

It is an additional object of the invention to provide a trash storage system having multiple compartments for separation of trash wherein the contents of the compartments can be selectively compacted by a single compacting unit.

These and other objects of the invention will become apparent from the following descriptions, figures and claims.

The trash storage system of the present invention in its simplest form has a turntable on which is mounted a container having a rim. The container has multiple trash compartments and each of the trash compartments is bound by compartment sidewalls. The sidewalls are so configured to provide compartments of uniform cross section.

A retaining plate is mounted above the container and in close proximity to the rim of the container. The retaining plate has at least a first opening therein and preferably a second opening therein.

A first platen is provided which is sized to engage the first opening. Preferably, when the first platen engages the first opening the maximum gap therebetween will be less than about ⅛ inch. The first platen and the first opening have a cross section which conforms to the cross section of the trash compartments so that the first platen will slidably engage the trash compartments. While it is preferred that the first platen slidably engages the trash compartments, it should be appreciated that a small gap of not more than about ⅛ of an inch can be left between the platen and the sidewalls without resulting in trash being trapped in the gap and detrimentally affecting the operation of the compacting cycle of the trash storage system.

When a second opening is provided in the retaining plate, a second platen is employed which is sized to engage the second opening. Again, it is preferred that when the second platen engages the second opening, the maximum gap left therebetween is not greater than about ⅛ inch. The second platen and the second opening are preferably shaped such that the second opening in the retaining plate is smaller than the cross section of the trash compartments so that when it is centered over a trash compartment for loading, the second opening will prevent spillage of the trash into adjacent compartments.

A means for slidably engaging and disengaging the first platen with the sidewalls of the trash compartments is provided. This means drives the platen and compacts the trash as the platen is slidably engaged with the compartments.

A first platen pressure sensor is provided which monitors the pressure on the first platen and, when a first platen preset compaction trigger pressure is reached, activates the means for slidably engaging and disengaging the first platen with the sidewalls, causing it to disengage the first platen from the compartment and returning it to a rest position. The rest position for the first platen is preferably in the plane of the retaining plate. Having the rest position of the first platen so defined ensures that the first platen provides continuity in the retaining plate and prevents the trash from catching in the first opening in the retaining plate when the turntable is rotated.

Means for accessing the compartments through the retaining plate are provided. When the retaining plate has only a first opening, access is provided through the first opening by providing means for opening and closing the first opening with respect to the first platen. It is further preferred that the first platen pressure sensor has a preset loading trigger pressure which, when reached, will deactivate the means for opening and closing the first opening and will activate an indicator that the trash storage system is full.

It is further preferred that the retaining plate is provided with a second opening and that the second opening is positioned with respect to the first opening such that when the first platen engages one of the compartments the second opening will be positioned over one of the other compartments. When a second opening is provided it provides access to the compartments of the container. When a second opening is provided, the earlier described means for opening and closing the first opening in the retaining plate is not employed. Instead, a means for opening and closing the second opening of the retaining plate is employed. This means moves the second platen from an open position to a closed position. In the open position, the second platen is not coplanar with the retaining plate and at least part of the second platen lies above the retaining plate and provides access to permit loading of the trash compartment positioned thereunder. In the closed position, the second platen and the retaining plate are substantially coplanar, and the trash is maintained at or below the level of the retaining plate, allowing rotation of the trash compartments without the contents becoming caught in one opening. The second platen may be moved in and out of the plane of the retaining plate either by a translational motion, keeping the plate in parallel relationship with regard to the retaining plate, or by a pivotal motion.

When a second platen is employed, a second platen pressure sensor is provided which senses the pressure on the second platen. When the pressure exceeds a preset loading trigger pressure, the second platen pressure sensor deactivates the means for moving the second platen and activates an indicator that the compactor system is full.

Indexing means are provided which position the turntable in such a way that the first platen selectively engages a pre-selected compartment.

It is further preferred that the components of the trash storage system of the present invention are mounted in a frame having a front opening. A drawer having a front door panel slidably engages the frame such that the front door panel closes the front opening of the frame. The drawer has mounted therein the turntable and the container. Having the turntable and the container so mounted allows emptying the trash compartments by opening the drawer and removing the trash containers.

It is further preferred that the front door panel has an upper door panel section and a lower door panel section. The upper door panel section lies above the retaining plate and has a chute door positioned therein. The chute door provides access to the compartment located below the first opening when the retaining plate has a single opening, and provides access to the compartment located below the second opening when the retaining plate has a second opening.

It is also preferred that the drawer has a base plate which has an upper base plate surface and a lower base plate surface. Bearings are provided between the upper base plate surface and the turntable to distribute the loads introduced by the first platen and the second platen.

It is still further preferred that there is a load bearing support mounted on the frame for providing additional support to the base plate of the drawer during the compaction of the trash in the compartments. The base plate is positioned such that the load bearing support slidably engages the lower surface of the base plate. Furthermore, the load bearing support should be positioned such that the support is under the first platen during the compaction cycle.

It is further preferred that index holes in the turntable are provided and that a pin is provided to engage the holes. The holes are so positioned to ensure that the first platen will slidably engage the compartments.

BRIEF DESCRIPTION OF FIGURES

FIG. 3 shows the trash storage system in the open position for removal of trash.

FIG. 5 shows the compactor of FIG. 4 where the system is ready to accept trash.

BEST MODE FOR CARRYING THE INVENTION INTO PRACTICE

Figure 1:
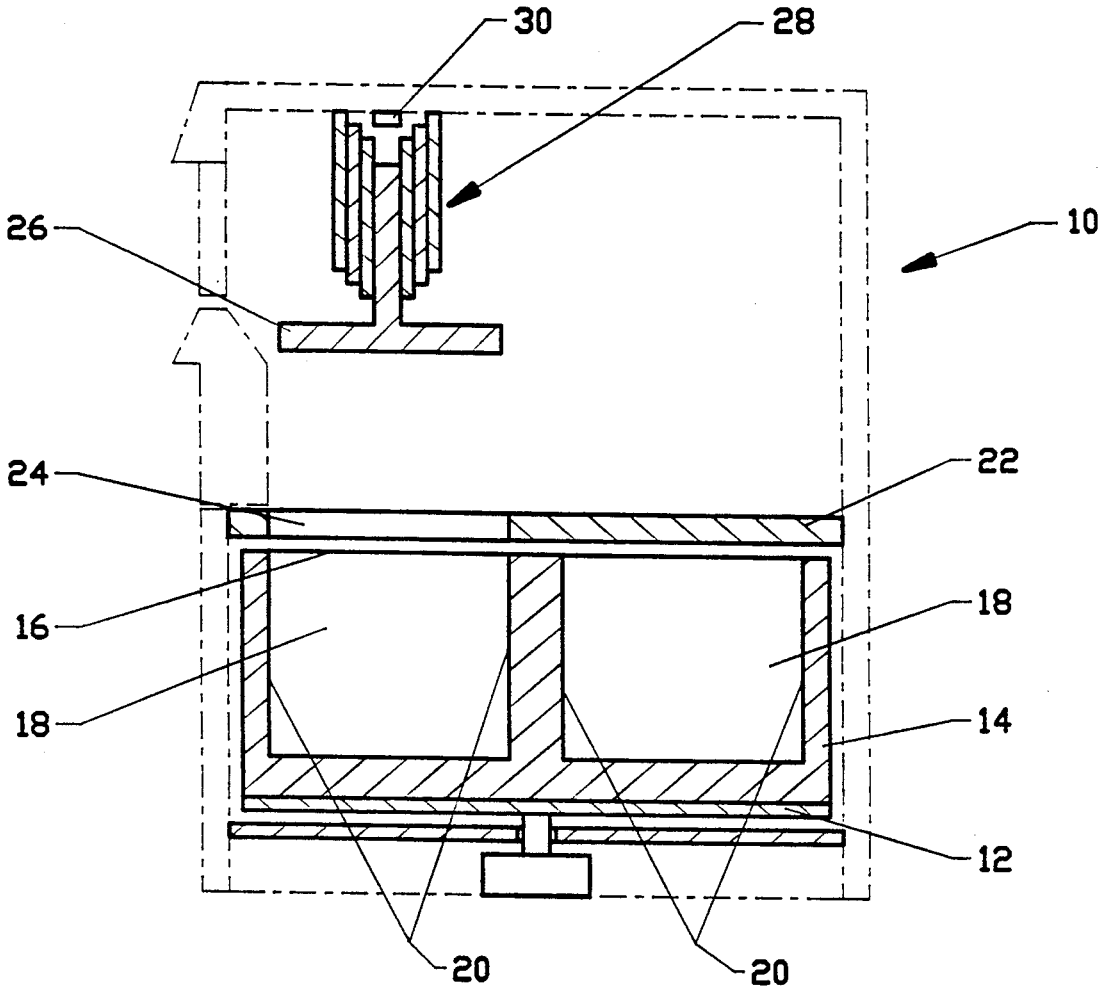
FIG. 1 is a schematic representation of one embodiment of the trash storage system of the present invention which employs a retaining plate with a single opening and a single platen. The means to engage and to disengage the platen is hydraulic.

FIG. 1 is a schematic representation of one embodiment of the present invention. The exterior surfaces of the trash storage system are shown in dotted lines. The trash storage system 10 has a turntable 12 and a container 14 mounted thereon. It should be appreciated that the turntable and the container 14 could be an integral unit. The container 14 has a rim 16 and multiple compartments 18 which are bounded by the rim 16. The compartments 18 have sidewalls 20 so configured to provide compartments of uniform cross section A shown in FIG. 3. A retaining plate 22 is mounted above the container 14 and in close proximity to the rim 16 of the container 14. The retaining plate 22 has a first opening 24.

A first platen 26 is provided, which is sized to engage and close the first opening 24 in the retaining plate 22. Preferably, when the first platen 26 engages the first opening 24, the maximum gap therebetween will be less than about ⅛ of an inch. The first platen 26 and the first opening 24 have a cross section which conforms to the cross section A (shown in FIG. 3) of the trash compartments 18, so that the first platen 26 will slidably engage one of the trash compartments 18. While it is preferred that the first platen 26 slidably engages one of the trash compartments 18, it should be appreciated that small gaps, not more than about ⅛ of an inch, can be left between the first platen 26 and the sidewalls 20 of any of the compartments 18. Such a gap will protect against trash being trapped in the gap when the platen 26 compresses the trash in the selected compartment 18, which could detrimentally effect the efficient operation of the trash storage system 10.

A telescopic hydraulic jack 28 serves as means for engaging and disengaging the first platen 26 with the sidewalls 20 of the selected compartment 18. A first platen pressure sensor 30 is provided to monitor the pressure exerted on the first platen 26 by trash being compacted by the first platen 26 when it engages a trash filled compartment. The first platen pressure sensor 30 must be positioned so as to monitor the integrated pressure resulting from the trash on the platen. In the case of a hydraulic jack, this can be readily accomplished by sensing the pressure in the fluid of the hydraulic jack 28. When the pressure monitored exceeds a preset compaction trigger pressure, the pressure is reduced in the hydraulic jack 28 and the first platen 26 is raised by the hydraulic jack 28 until it returns to a rest position where the first platen 26 lies in the plane of the retaining plate 22. Regulating the pressure in the hydraulic jack 28 can be accomplished by employing a programmable microprocessor or an electronic circuit which controls a pumping system. Such pressure regulating systems are known by one skilled in the art. Having the rest position of the first platen 26 so defined ensures that the first platen 26 prevents trash from catching in the first opening 24 as the turntable 12 revolves.

When a retaining plate 22 with a single opening is employed, as illustrated in FIG. 1, access to and loading of each of the compartments 18 is provided by the first opening 24. In order for the opening 24 to serve this purpose, a means for opening and closing the access to the compartments 18 is provided. This means provides movement to the first platen 26 such that the first platen 26 is removed from the first opening 24 without entry of the first platen 26 into the selected compartment 18. The opening and closing for the embodiment of FIG. 1 is provided by the hydraulic jack 28. Again, the means for adjusting the pressure on the hydraulic jack 28, which opens and closes the movement of the first platen 26, can be a microprocessor or an electronic circuit in combination with a pump.

In order to determine if the trash storage system 10 of FIG. 1 is full, a preset loading trigger pressure is defined which, when reached, causes the sensor to deactivate the means for opening and closing the platen 26 and to provide a signal that the compacting system 10 is full. The signal remains on and the system remains deactivated until the drawer is opened and the compartment is unloaded.

Figure 2:
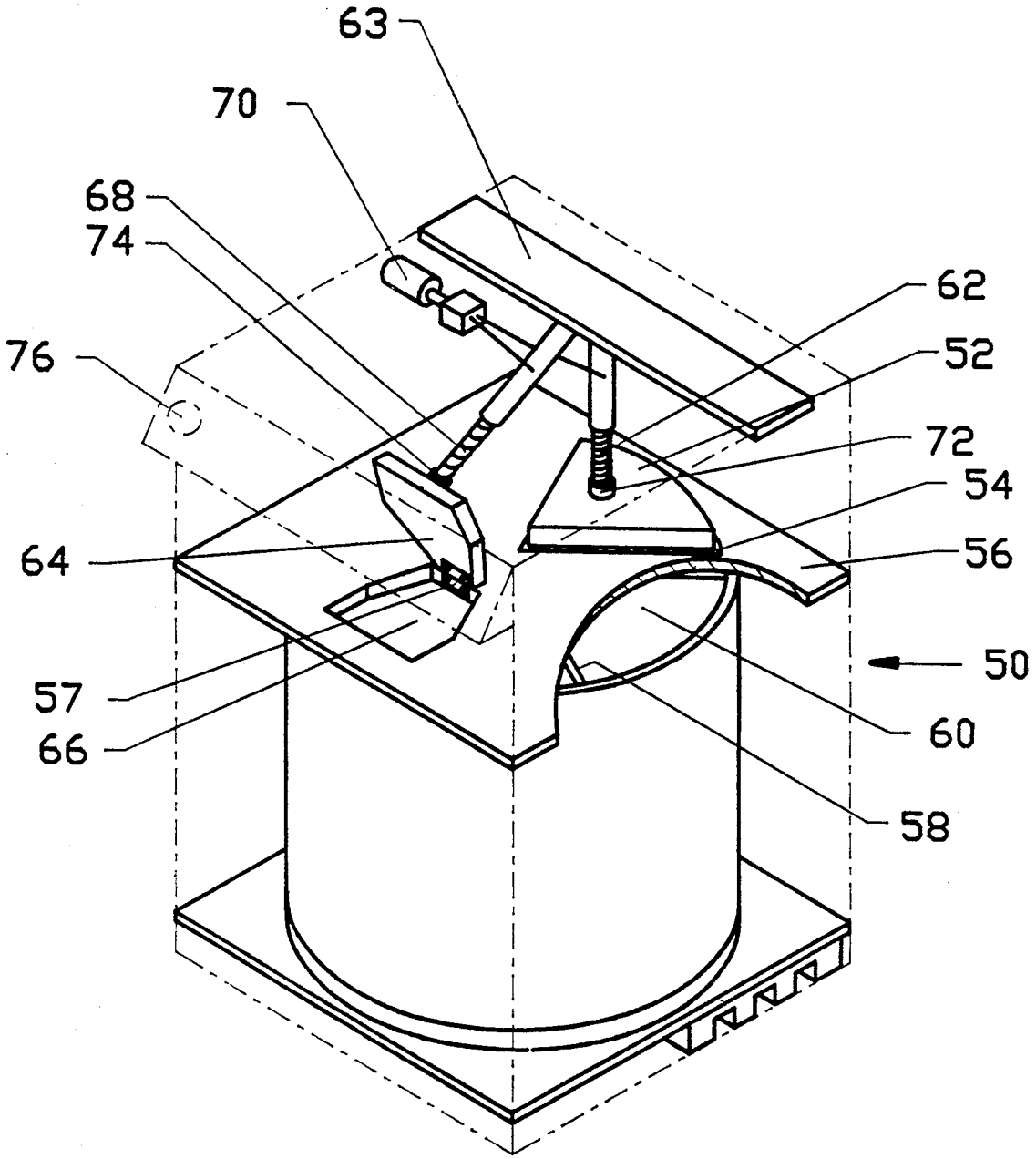
FIG. 2 is a schematic representation of a second embodiment of the trash storage system of the present invention, which illustrates a retaining plate with a first and second opening. The embodiment shown in FIG. 2 has a first platen and a second platen. Means for slidably engaging and disengaging the first platen is mechanical, as is the means for moving the second platen. The second platen is pivotably mounted on the retaining plate.

FIG. 2 is a second embodiment of a trash storage system 50. The embodiment in FIG. 2 differs from the embodiment in FIG. 1 in two principal respects. First, it has multiple platens and second, it uses mechanical means for positioning the platens. The trash storage system 50 has a first platen 52 which passes through the first opening 54 in the retaining plate 56 and thereafter slidably engages the sidewalls 58 of one of the compartments 60. A first screw jack 62 serves as means for slidably engaging and disengaging the first platen 52 with the selected compartment 60. The screw jack 62 is rigidly mounted to the first platen 52 and a brace member 63. A second platen 64 engages the second opening 66 in the retaining plate 56. The second platen 64 is pivotably mounted on the retaining plate 56 with a hinge 57, and a second screw jack 68 opens and closes the second opening 66 with the second platen 64. The second screw jack 68 is pivotably mounted to the second platen 64 and the brace member 63, thereby allowing the second screw jack 68 to adjust in accordance with the movement of the second platen 64.

In the embodiment of FIG. 2 the screw mechanism for the screw jacks 62 and 68 are driven by a motor 70. The motor is selectively engaged with the screw jack (62 and 68) through gear trains (not shown) and the platens (52 and 64) are moved in or out of the retaining plate 56 depending on the direction of rotation of the motor 70. A microcomputer or a switching circuit in combination with the reversible motor can serve to control the movement of the platens.

A first platen pressure sensor 72 is provided to sense the pressure on the first platen 52 resulting from compacting of trash in the compartments 60 by the first platen 52. Again, as discussed with respect to the embodiment of FIG. 1, the first platen pressure sensor 72 must be so positioned to monitor the integrated pressure on the first platen 52. This can be readily accomplished by having the first platen sensor 72 in the line of force between the screw jack 62 and the first platen 52. Alternatively, the sensing of the pressure can be monitored by a torque sensor which monitors the torque on the motor 70. In either case, the pressure sensor monitors the pressure exerted by the trash on the platen as it is being compacted by the first platen 52. When the pressure sensor exceeds a preset compression trigger pressure, the motor 70 is reversed and the first platen 52 is returned to its rest position, which is in the plane of the retaining plate 56.

A second pressure sensor 74 is provided to the second platen 64 and senses the pressure exerted by the trash on the second platen 64. When the pressure on the second pressure sensor 74 exceeds a preset loading trigger pressure, the motor 70 is reversed and the second platen 64 is raised to provide access to the trash. This allows removal of excess trash when the trash storage system 50 has been overloaded.

In a preferred embodiment, a first limit switch is provided to turn off the motor when the second platen 64 is fully raised. A second limit switch is provided to turn off the motor when the second platen 64 is in the plane of the retaining plate 56.

It is further preferred that a notice is provided when the trash storage system 50 is full. This can be accomplished by providing a light 76, which turns on when the loading trigger pressure is reached.

Figure 3:
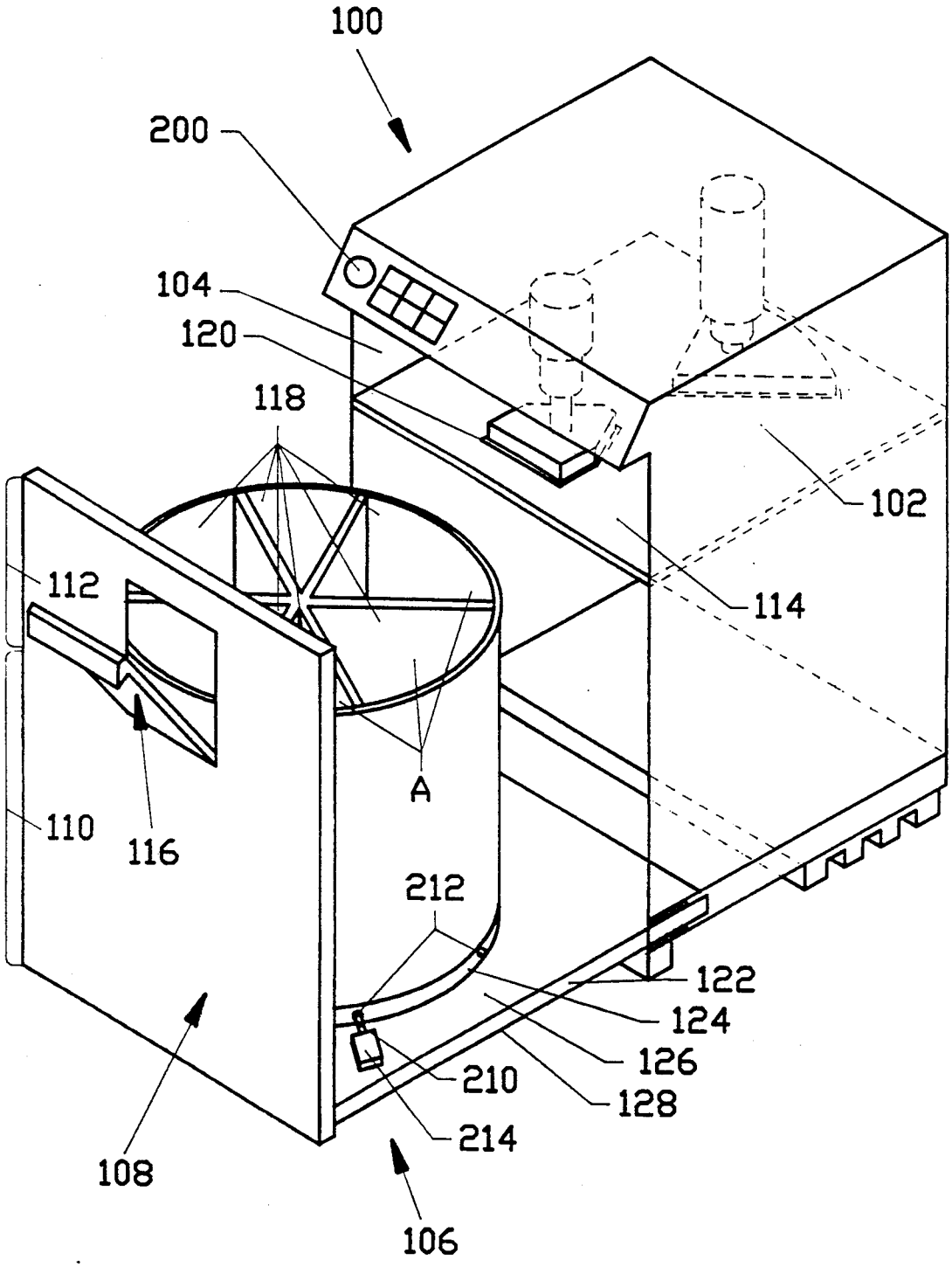
FIG. 3 is a schematic representation of a third embodiment of the trash storage system of the present invention. This embodiment employs a retaining plate with a first opening and a second opening. Two platens are used in this embodiment. Hydraulic means are used for activating the platens. In this embodiment the second platen translates such that the second platen and the retaining plate remain substantially parallel at all times.

FIG. 3 is another embodiment of the present invention for a trash storage system 100, and it is similar in many respects to the trash storage system 50 shown in FIG. 2. The embodiment of FIG. 3 is shown in the open position for removing trash. The principal difference between the embodiment of FIG. 3 and that of FIG. 2 is that in FIG. 3 the means for activating the platens are hydraulic and the second platen translates parallel to the retaining plate.

A frame 102 is provided with a front opening 104. The frame 102 is so configured that the trash storage system 100 will be contained therein when the system is in the closed position as illustrated in FIG. 4.

Referring again to FIG. 3, a drawer 106 slidably engages the frame 102. The drawer 106 has a front door panel 108 which has a lower door panel element 110 and an upper door panel element 112. The upper door panel element 112, which is above a retaining plate 114, has a chute door 116 therein. The chute door 116 provides access to any one of the compartments 118 when the compartment 118 is located below the second opening 120 in the retaining plate 114.

The drawer 106 has a base plate 122 above which is mounted a turntable 124. The base plate 122 has an upper base plate surface 126 and a lower base plate surface 128.

Figure 4:
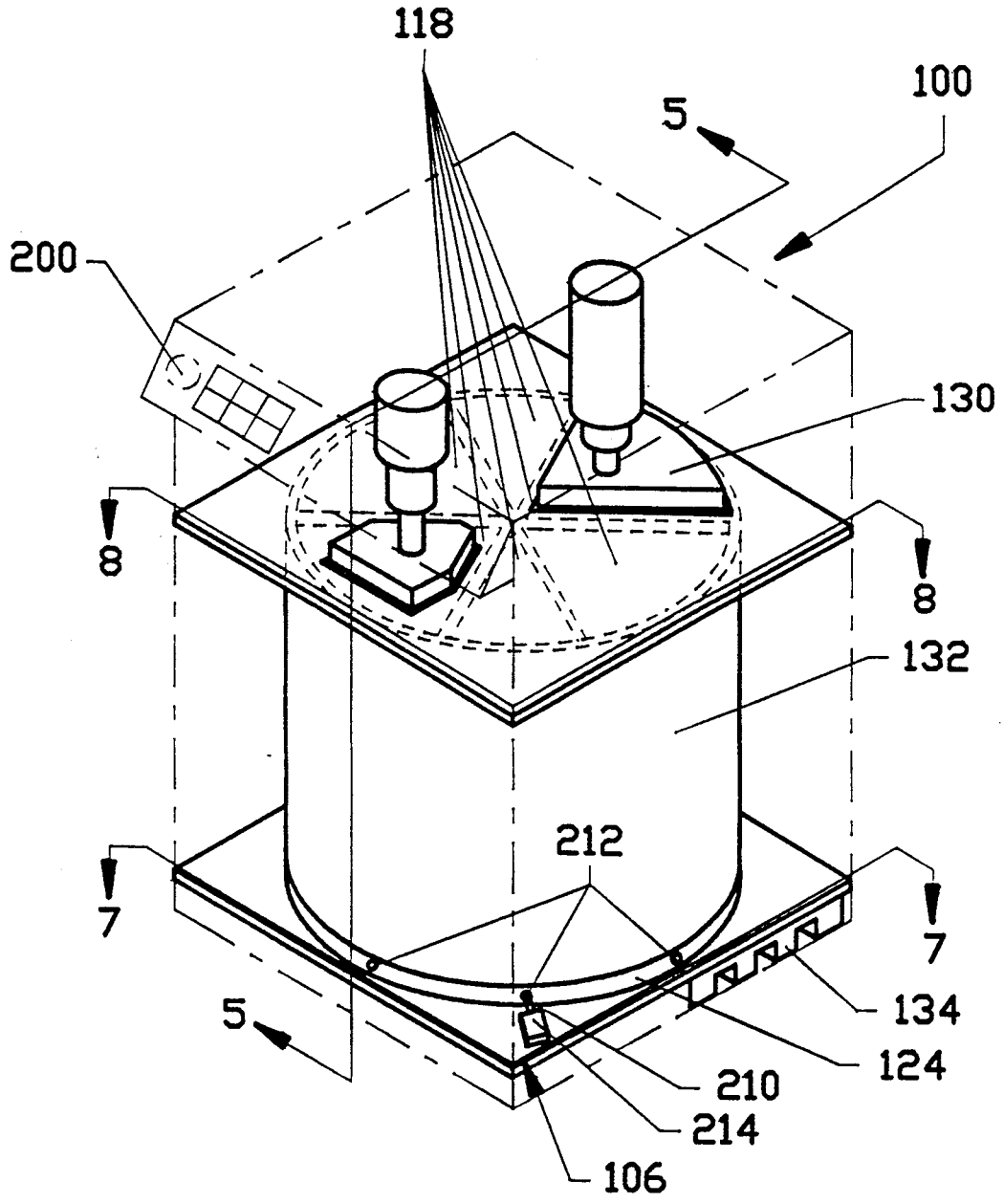
FIG. 4 is the embodiment of FIG. 3 in the closed position, ready for trash storage and compaction.

FIG. 4 is the trash storage system 100 of FIG. 3 in the closed position. When the drawer 106 is closed as shown, a first platen 130 is above the turntable 124 and will slidably engage compartments 118 of a container 132, which is mounted on the turntable 124. A load bearing support 134 is located under the drawer 106 and positioned beneath the first platen 130 which slidably engages the selected compartment 118. The load bearing support 134 provides additional support for the turntable 124.

Figure 5:
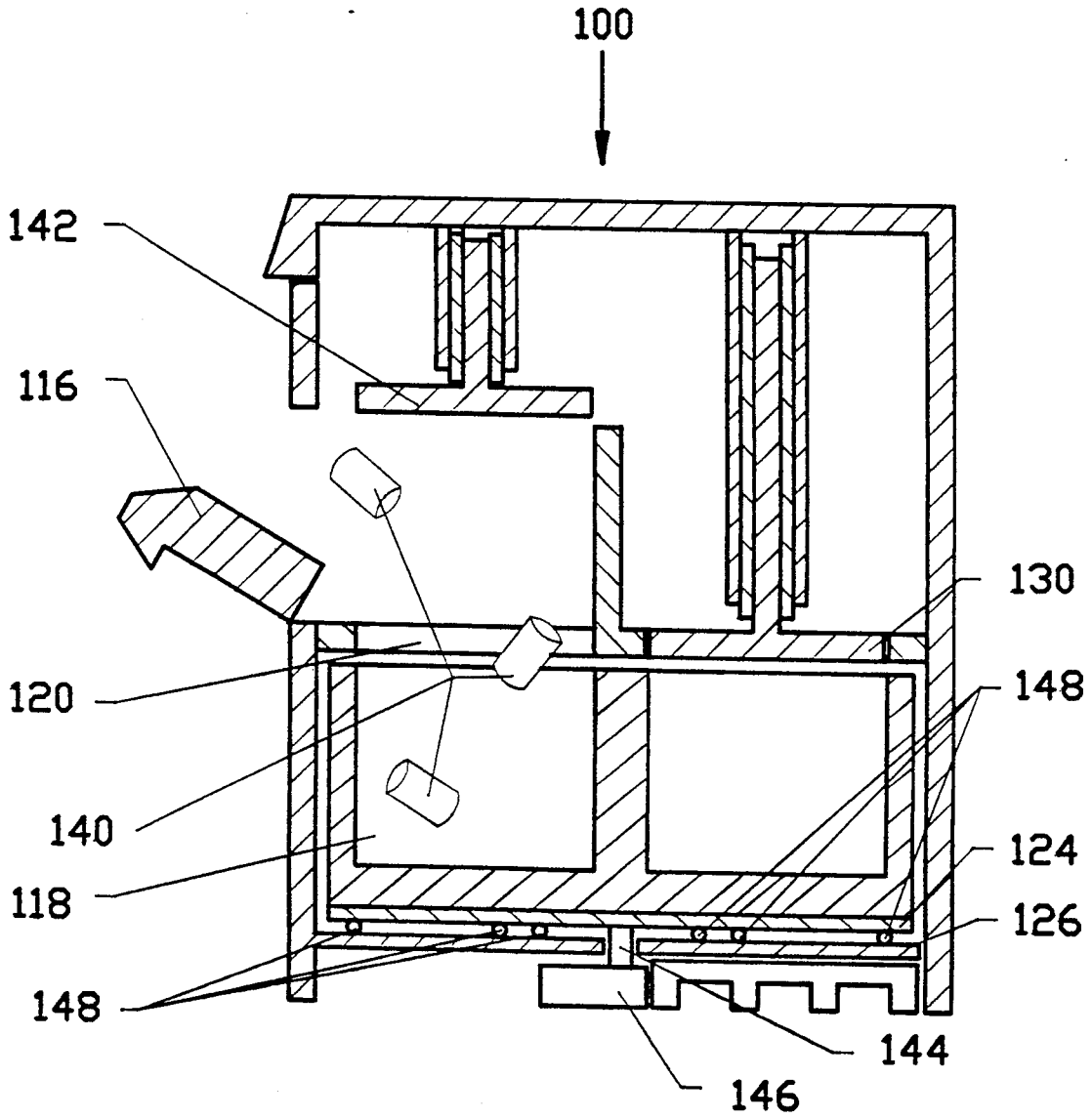
FIG. 5 is the section 5—5 of FIG. 4.

FIG. 5 is a cross section 5—5 of FIG. 4 which shows additional details of the embodiment of FIG. 4. When trash 140 is loaded into the trash storage system 100 of FIG. 5, the trash 140 is loaded through the second opening 120. The trash storage system 100 is illustrated with the chute door 116 open, and the trash storage system 100 is ready to be loaded with trash. When the door is opened, a switch (not shown) is toggled which activates the pump, reduces the pressure, and raises a second platen 142 which opens the second opening 120. When the second platen 142 is raised trash can be loaded into the compartment 118. After the trash 140 is added, the chute door 116 is closed, activating the pump which increases the pressure, causing the second platen 142 to be lowered, which compresses the trash 140. The second platen 142 continues its downward motion until it closes the second opening 120. The turntable 124 is then rotated on a shaft 144, which is driven by a motor 146, so that the trash 140 will be rotated into position under the first platen 130. The motor 146, which positions the turntable 124, is preferably an electric motor or a hydraulic motor. Additional support for the turntable 124 is provided by bearings 148 which stabilize the turntable 124 when the trash 140 is compacted. The bearings 148 are mounted on the upper base plate surface 126 and the turntable 124 rides thereon.

The motor 146 turns the turntable 124 so that the selected compartment 118, as shown in FIG. 4, may be moved from the loading position under the second opening 120 to a position under the first platen 130 which serves to compact the trash 140.

Figure 6:
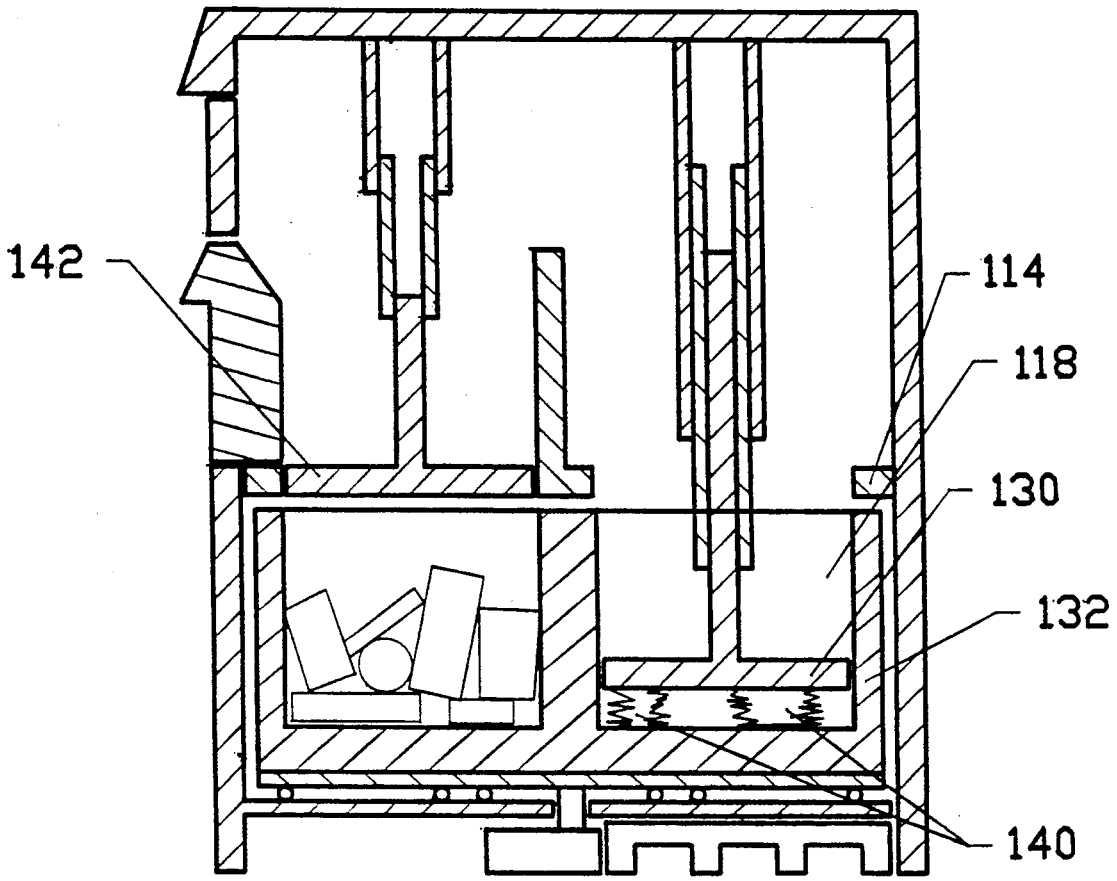
FIG. 6 shows the same cross section as FIG. 5; however, the first platen is positioned in one of the trash compartments where it will compact the contents.

FIG. 6 shows the same cross section as FIG. 5; however, the second platen 142 is now lowered so as to lie in the plane of the retaining plate 114, facilitating the rotation of the container 132. In addition, the first platen 130 is extended into one of the compartments 118, compressing trash 140 and reducing the volume of the trash 140.

Figure 7:
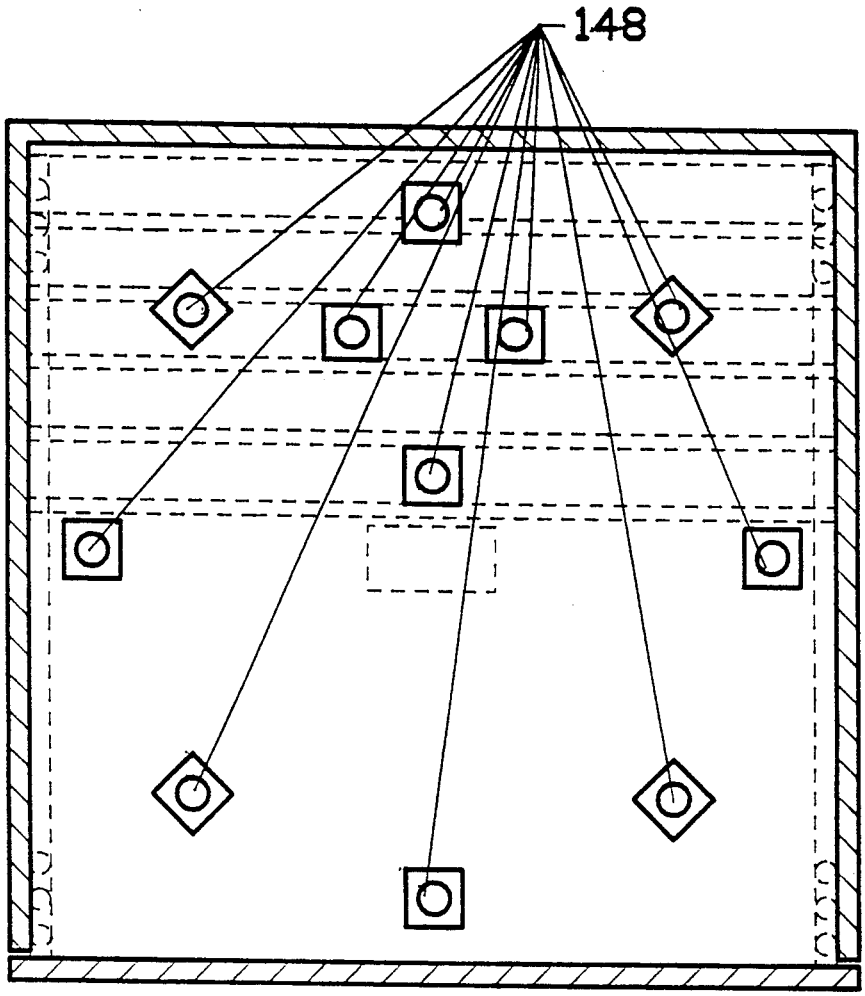
FIG. 7 is a cross section 7—7 of FIG. 4, showing details of the structure below the turntable.

FIG. 7 shows a cross section 7—7 of the trash storage system 100 of FIG. 4, which illustrates the spacial relation of the bearings 148. The bearings 148 are distributed in a ring near the edge of the turntable 124 thereby stabilizing the turntable 124 when compressive loads are applied by either the first platen 130 or the second platen 142. Additional support bearings are located under the first platen 130, as shown in FIG. 6. The additional support bearings provide adequate support during the heavy compression loads resulting from the extension of the first platen 130 during the compaction process.

Figure 8:
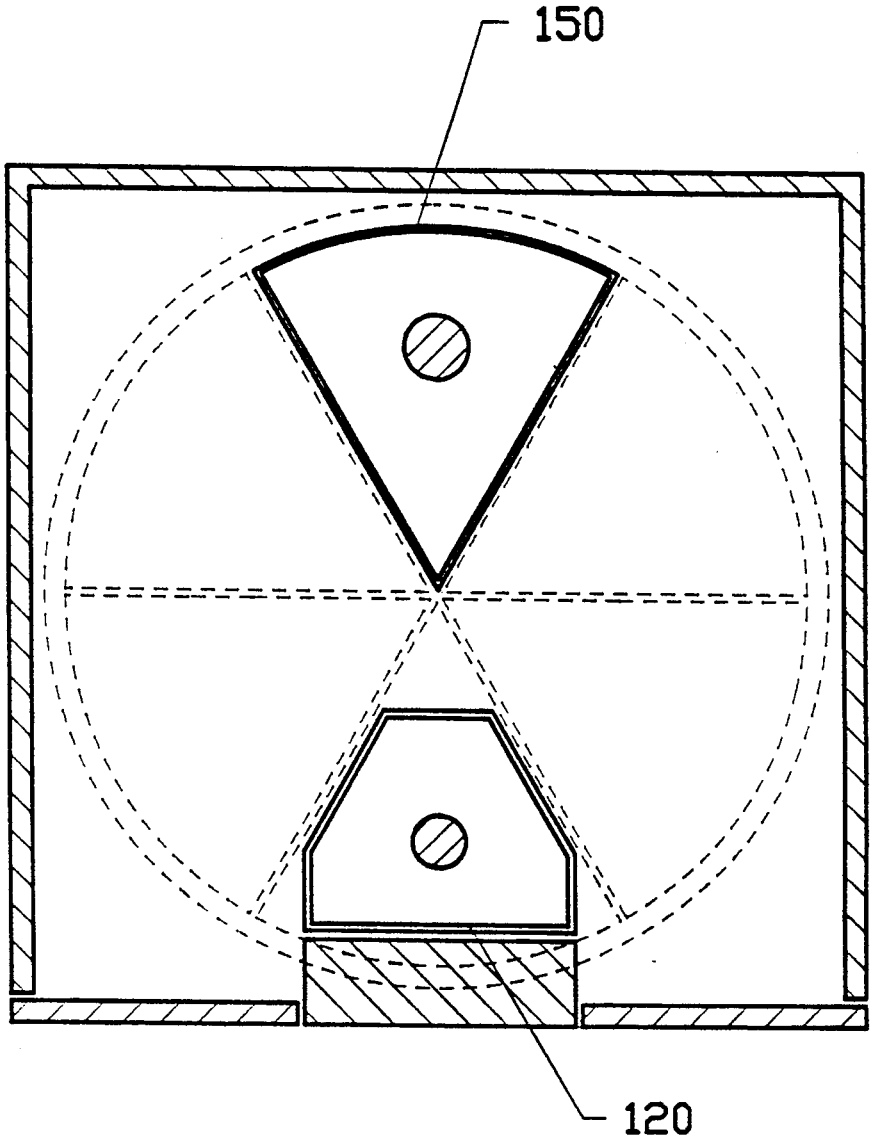
FIG. 8 is a cross section 8—8 of FIG. 4 taken above the retaining plate.

FIG. 8 is another cross section 8—8 of the storage system 100 of FIG. 4. This section, taken above the retaining plate 114, illustrates the location of the first opening 150 and the second opening 120. The first opening 150, as can be seen, is approximately the same size as the cross section of the compartment 118 located thereunder. The second opening 120 is smaller and lies within the cross section of the compartment 118 located thereunder. This configuration ensures that trash will be provided only to the compartment thereunder.

Figure 9:
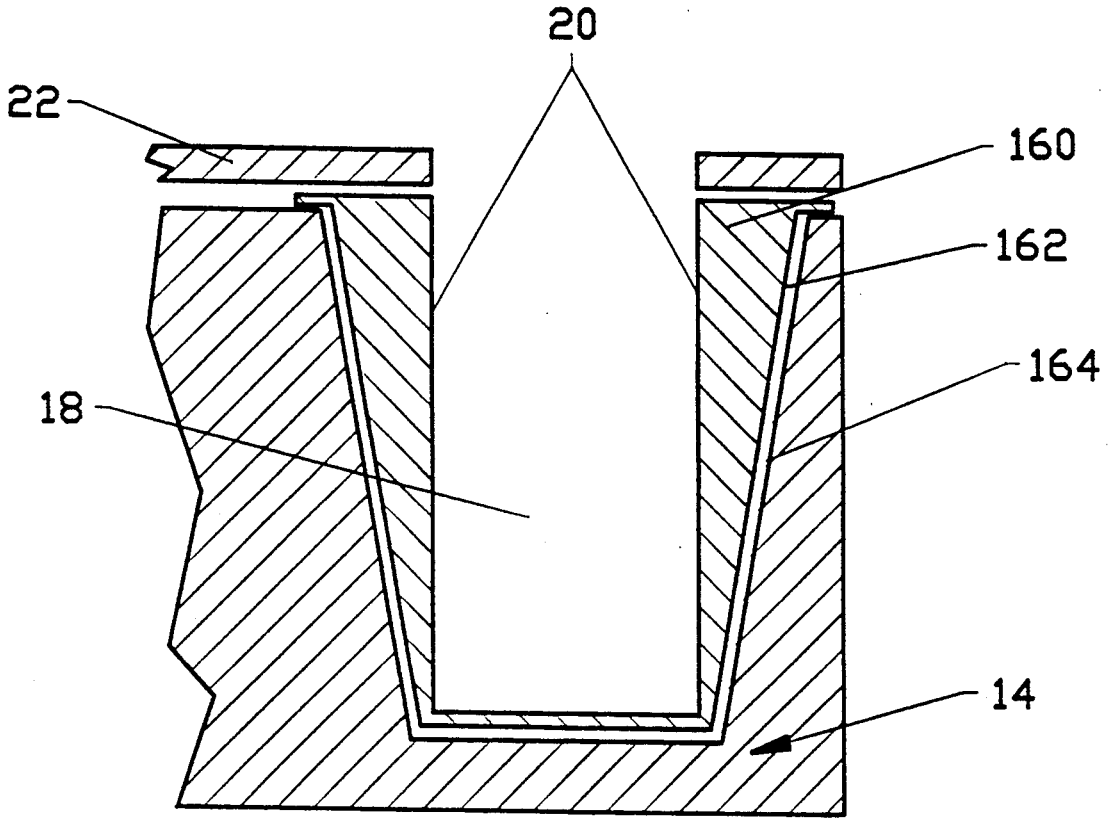
FIG. 9 illustrates a preferred embodiment for a removable compartment liner for the present invention.

FIG. 9 illustrates a preferred configuration of the compartment 18 wherein the compartment 18 fits into a container 14 and is defined by an insert 160. The sidewalls 20 define the interior of the compartment 18. FIG. 9 also illustrates another embodiment of the trash storage system of the present invention. In this embodiment a rigid insert 160 defines the extremities of a compartment 18, such as shown in FIG. 1. Preferably the rigid insert 160 is made of plastic and has an outer wall 162, which is angled and conforms to a support wall 164 of the container 14. The sidewalls 20, which serve as the interior walls of the insert 160, are at right angles with the retaining plate 22. This configuration provides a variable thickness sidewall which creates a uniform cross-section inside the insert 160.

EXAMPLE

In order to provide one with a more complete understanding of the operation of the present invention, the following example is given.

Referring to FIGS. 3 and 4, the trash separation and storage system 100 shown therein has on its front a control panel 200 which allows the user to select a storage compartment. The control panel 200 allows one to select the rotation for the turntable that will align parallel compartments with either the door 116 or the first platen 130 which compacts the contents of the underlying compartment.

The control panel 200 shown in FIGS. 3 and 4 has six buttons 202 which correspond to the six compartments of the trash storage system. Each compartment is designated to store a different type of material such as paper, glass, plastic, aluminum, tin or those materials not to be recycled.

When the user selects a setting, such as the paper setting, the corresponding compartment is rotated into position at the front of the trash storage system. Either a microprocessor or standard circuitry is used to activate the system response to the selection by the user. The compartments may be selected randomly and it is not necessary to select or fill the compartments in any particular order. The user can then deposit the paper into the paper compartment and when the compartment door is closed the turntable 124 is activated to rotate the paper compartment into position under the compacting platen. An index pin 210 can be engaged in indexing holes 212 to assure alignment of the compartment 118 with first platen 130. The index pin 210 is activated by a solenoid 214, which is responsive to a microcomputer or circuitry employed.

Once the compartment is positioned, the compacting platen will then be lowered into the paper compartment, compressing the paper. The compacting platen then returns to its position above the retaining plate and the trash storage system is then ready for the user to select another compartment.

The microprocessor or circuitry can be pre-programmed so that some compartments will not be compacted when the trash storage system is activated. For example, if the glass compartment is programmed to not compact, then when the user selects glass on the control panel, the glass compartment will rotate into position at the front of the trash storage system as usual. After the glass is inserted in the compartment through the panel door and the trash storage system is automatically activated by closing the panel door, the glass compartment will rotate to the back of the trash storage system, but the compaction platen will not be lowered, leaving the contents of the compartment uncrushed. This feature is convenient as some recycling centers will not accept crushed or broken materials, such as glass or aluminum cans. The chosen materials can be stored in the "as is" or uncrushed form while other materials can be compacted to conserve space.

While the novel features of the present invention have been described in terms of particular embodiments and a particular example, it should be apparent to one skilled in the art that substitution of materials and details can be made without departing from the spirit of the invention.

What I claim is:

1. A trash storage system comprising:

a turntable;

a container having a rim, said container having multiple trash compartments, each of said trash compartments being bound by compartment sidewalls providing trash compartments having uniform cross section; said container being mounted on said turntable;

a retaining plate mounted above said container and in close proximity to said container rim, said retaining plate having at least a first opening therein, said first opening having a first opening cross section substantially the same as said uniform cross section of said trash compartments;

a first platen having a cross section substantially the same as said uniform cross section of said trash compartments;

means for engaging and disengaging said first platen with said compartments;

means for accessing said compartments through said retainer plate; and means for positioning said turntable such that said first platen can selectively engage said compartments.

2. The trash storage system of claim 1 wherein said means for engaging and disengaging said first platen is a first platen jack.

3. The trash storage system of claim 2 wherein said means for positioning said turntable is a motor.

4. The trash storage system of claim 3 wherein said means for accessing said compartments through the retainer plate is said first opening in said retaining plate.

5. The trash storage system of claim 2 wherein said first platen jack is selected from the group of jacks consisting of screw jacks and hydraulic jacks.

6. The trash storage system of claim 1 further comprising:

a second opening in said retaining plate, said second opening being so positioned that when said first opening is centered over one of said trash compartments said second opening is centered over another of said trash compartments;

a second platen sized to engage said second opening in said retaining plate; and means for engaging and disengaging said second platen in said second opening.

7. The trash storage system of claim 6 wherein said means for engaging and disengaging said first platen is a first platen jack and further wherein said means for engaging and disengaging said second platen is a second platen jack.

8. The trash storage system of claim 7 wherein said first platen jack and said second platen jack are selected from the group of jacks consisting of screw jacks and hydraulic jacks.

9. The trash storage system of claim 6 further comprising:

a frame for enclosing said turntable, said retaining plate, said first platen, and said means for positioning said turntable;

a front opening in said frame; and a drawer slidably engaging said front opening, said drawer, containing said turntable and said container, being mounted thereon said turntable.

10. The trash storage system of claim 1 further comprising:

a frame for enclosing said turntable, said retaining plate, said first platen, and said means for positioning said turntable;

a front opening in said frame; and a drawer slidably engaging said front opening, said drawer, containing said turntable and said container, with said turntable being rotatably mounted to said drawer.

* * * * *